US009001105B2

(12) United States Patent
Han et al.

(10) Patent No.: US 9,001,105 B2
(45) Date of Patent: Apr. 7, 2015

(54) ORGANIC LIGHT EMITTING DISPLAY INCLUDING POWER SOURCE DRIVERS CONFIGURED TO SUPPLY A PLURALITY OF VOLTAGE LEVELS

(75) Inventors: Sang-Myeon Han, Yongin (KR); Baek-Woon Lee, Yongin (KR); Si-Duk Sung, Yongin (KR); In-Hwan Ji, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 656 days.

(21) Appl. No.: 12/939,111

(22) Filed: Nov. 3, 2010

(65) Prior Publication Data

US 2012/0007848 A1 Jan. 12, 2012

(30) Foreign Application Priority Data

Jul. 6, 2010 (KR) ..... 10-2010-0064850

(51) Int. Cl.

*G09G 3/30* (2006.01)
*G09G 3/32* (2006.01)
*G09G 3/00* (2006.01)

(52) U.S. Cl.

CPC ..... *G09G 3/3233* (2013.01); *G09G 2300/0866* (2013.01); *G09G 2300/0819* (2013.01); *G09G 2300/0852* (2013.01); *G09G 3/003* (2013.01); *G09G 2310/0248* (2013.01)

(58) Field of Classification Search

CPC .. G09G 3/3208; G09G 3/3225; G09G 3/3233
USPC ..... 345/76–83, 211–213
See application file for complete search history.

(56) References Cited

U.S. PATENT DOCUMENTS 5,990,629 A 11/1999 Yamada et al.
6,229,506 B1 5/2001 Dawson et al.

(Continued)

FOREIGN PATENT DOCUMENTS

CN 1677470 A 10/2005
CN 1766974 A 5/2006

(Continued)

OTHER PUBLICATIONS

EPO Search Report dated Nov. 2, 2010 for Euorpean Patent application 10171400.4, (6 pages).

(Continued)

*Primary Examiner* — Srilakshmi K Kumar
*Assistant Examiner* — James Nokham
(74) *Attorney, Agent, or Firm* — Christie, Parker & Hale, LLP

(57) ABSTRACT

An organic light emitting display includes a display unit including pixels coupled to scan lines, first control lines, second control lines, and data lines, a control line driver configured to supply a first control signal and a second control signal to the pixels through the first control lines and the second control lines, a first power source driver for applying a first power to the pixels of the display unit, and a second power source driver for applying a second power to the pixels of the display unit. At least one of the first power or the second power is applied to the pixels of the display unit as voltage values having different levels during one frame. The first and second control signals and the first and second powers are concurrently provided to all of the pixels of the display unit.

9 Claims, 8 Drawing Sheets

(56) References Cited

U.S. PATENT DOCUMENTS

| | | | | |
|---|---|---|---|---|
| 6,380,689 | B1 | 4/2002 | Okuda | |
| 6,731,276 | B1 | 5/2004 | Ishizuka | |
| 7,944,414 | B2 | 5/2011 | Shirasaki et al. | |
| 7,960,917 | B2 | 6/2011 | Kimura | |
| 8,072,396 | B2 | 12/2011 | Kitazawa et al. | |
| 2004/0095298 | A1 | 5/2004 | Miyazawa | |
| 2004/0174349 | A1 | 9/2004 | Libsch et al. | |
| 2004/0239664 | A1 | 12/2004 | Hu et al. | |
| 2005/0140600 | A1* | 6/2005 | Kim et al. | 345/76 |
| 2005/0200575 | A1 | 9/2005 | Kim et al. | |
| 2005/0206591 | A1* | 9/2005 | Wang et al. | 345/76 |
| 2006/0007072 | A1* | 1/2006 | Choi et al. | 345/76 |
| 2006/0139255 | A1 | 6/2006 | Kim et al. | |
| 2006/0170625 | A1* | 8/2006 | Kim | 345/76 |
| 2006/0290614 | A1 | 12/2006 | Nathan et al. | |
| 2007/0035534 | A1 | 2/2007 | Yamazaki | |
| 2007/0115225 | A1 | 5/2007 | Uchino et al. | |
| 2007/0290954 | A1 | 12/2007 | Miyazawa | |
| 2008/0030436 | A1 | 2/2008 | Iida et al. | |
| 2008/0036706 | A1 | 2/2008 | Kitazawa | |
| 2008/0036710 | A1* | 2/2008 | Kim | 345/82 |
| 2008/0049007 | A1 | 2/2008 | Iida et al. | |
| 2008/0074413 | A1 | 3/2008 | Ogura | |
| 2008/0088548 | A1 | 4/2008 | Lee et al. | |
| 2008/0100544 | A1 | 5/2008 | Wu | |
| 2008/0165095 | A1 | 7/2008 | Jeon et al. | |
| 2008/0252569 | A1* | 10/2008 | Kwon | 345/76 |
| 2009/0015166 | A1 | 1/2009 | Kwon | |
| 2009/0051628 | A1 | 2/2009 | Kwon | |
| 2009/0058843 | A1 | 3/2009 | Ishizuka | |
| 2009/0109150 | A1 | 4/2009 | Han et al. | |
| 2009/0184896 | A1* | 7/2009 | Kwon | 345/76 |
| 2009/0284519 | A1* | 11/2009 | Kim et al. | 345/213 |
| 2009/0315977 | A1 | 12/2009 | Jung et al. | |
| 2010/0289883 | A1 | 11/2010 | Goris et al. | |
| 2012/0007842 | A1 | 1/2012 | Nathan et al. | |

FOREIGN PATENT DOCUMENTS

| | | | |
|---|---|---|---|
| CN | 1881397 | A | 12/2006 |
| EP | 1 418 566 | A2 | 5/2004 |
| EP | 1 785 979 | A2 | 5/2007 |
| JP | 61-232494 | | 10/1986 |
| JP | 2000-112428 | | 4/2000 |
| JP | 2001-356738 | | 12/2001 |
| JP | 2004-280059 | | 10/2004 |
| JP | 2004-295131 | | 10/2004 |
| JP | 2007-47342 | | 2/2007 |
| JP | 2007-148129 | | 6/2007 |
| JP | 2007-206273 | | 8/2007 |
| JP | 2008-523425 | | 7/2008 |
| JP | 2008-225492 | | 9/2008 |
| JP | 2008-542845 | | 11/2008 |
| JP | 2009-152897 | A | 7/2009 |
| KR | 10-2006-0104841 | A | 10/2006 |
| KR | 10-2006-0112991 | A | 11/2006 |
| KR | 10-0646989 | B1 | 11/2006 |
| KR | 10-0658271 | B1 | 12/2006 |
| KR | 10-2007-0029997 | | 3/2007 |
| KR | 10-2007-0114641 | | 12/2007 |
| KR | 10-0839429 | B1 | 6/2008 |
| KR | 10-2008-0093750 | | 10/2008 |
| TW | 200630932 | A | 9/2006 |
| TW | 200746782 | A | 12/2007 |
| TW | 200816142 | A | 4/2008 |
| TW | 200818099 | A | 4/2008 |
| TW | 200820199 | A | 5/2008 |
| WO | WO 2007/021458 | A1 | 2/2007 |

OTHER PUBLICATIONS

EPO Search Report dated Oct. 5, 2010 for European Patent application 10171396.4, (7 pages).

KIPO Office action dated Mar. 8, 2011 for Korean Patent application 10-2009-0071279, (5 pages).

KIPO Office action dated Jul. 28, 2011 for Korean Patent application 10-2009-0071279, (1 page).

SIPO Office action dated Jun. 11, 2012 for Chinese Patent application 201010228279.0 (3 pages).

JPO Office action dated Aug. 7, 2012 for Japanese Patent application 2009-244710, (2 pages).

KIPO Office action dated Mar. 8, 2011 for Korean Patent application 10-2009-0071280, (4 pages).

EPO Office action dated Sep. 7, 2011 for European Patent application 10171396.4, (18 pages).

KIPO Office action dated Oct. 31, 2011 for Korean Patent application 10-2009-0071280, (2 pages).

JPO Office action dated Feb. 14, 2012 for Japanese Patent application 2009-254936, (5 pages).

SIPO Office action dated Jun. 11, 2012 for Chinese Patent application 201010214454.0, (3 pages).

Taiwan Office action dated May 21, 2013 for Taiwanese Patent application 099120347, (8 pages).

U.S. Office action dated Jun. 21, 2013, for cross reference U.S. Appl. No. 12/784,411, (29 pages).

U.S. Office action dated Jul. 15, 2013, for cross reference U.S. Appl. No. 12/786,254, (20 pages).

Taiwan Office action dated Aug. 15, 2013, with English translation, for Taiwanese Patent application 099120349, (9 pages).

SIPO Certificate of Invention Patent dated Mar. 12, 2014, for corresponding Chinese Patent Application No. 201010228279.0, with English translation of page 1 only, (3 pages).

U.S. Office action dated Dec. 18, 2013, for cross reference U.S. Appl. No. 12/784,411, (31 pages).

SIPO Certificate of Invention Patent dated Feb. 5, 2014, for corresponding Chinese Patent Application No. 201010214454.0, with English translation of page 1 only, (3 pages).

Taiwanese Patent Gazette dated Apr. 21, 2014, with English abstract, for Taiwanese Patent application 099120349, (2 pages).

U.S. Office action dated Jun. 11, 2014, for cross reference U.S. Appl. No. 12/784,411, (30 pages).

* cited by examiner

ORGANIC LIGHT EMITTING DISPLAY INCLUDING POWER SOURCE DRIVERS CONFIGURED TO SUPPLY A PLURALITY OF VOLTAGE LEVELS

CROSS-REFERENCE TO RELATED APPLICATION

This application claims priority to and the benefit of Korean Patent Application No. 10-2010-0064850, filed on Jul. 6, 2010, in the Korean Intellectual Property Office, the entire content of which is incorporated herein by reference.

BACKGROUND

1. Field

Embodiments of the present invention relate to an organic light emitting display.

2. Description of the Related Art

Recently, various flat panel displays (FPDs) capable of reducing weight and volume that are disadvantages of cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLED) that generate light by re-combination of electrons and holes. The organic light emitting display has high response speed and is driven with low power consumption.

In general, OLED displays are divided into passive matrix type OLED (PMOLED) displays and active matrix type OLED (AMOLED) displays according to a method of driving the OLED.

The AMOLED type display includes a plurality of gate lines, a plurality of data lines, a plurality of power source lines, and a plurality of pixels coupled to the above lines to be arranged in the form of a matrix. In addition, each of the pixels typically includes an OLED, two transistors (e.g., a switching transistor for transmitting a data signal and a driving transistor for driving the EL element in accordance with the data signal), and a capacitor for maintaining the data voltage.

The AMOLED type display typically has low power consumption. However, the intensity of current that flows through the OLED varies with deviation in a voltage between the gate and source of the driving transistor for driving the OLED. That is, variations in the threshold voltage of the driving transistor can cause non-uniformity in the display.

Because the characteristics of the transistors provided in each of the pixels vary with manufacturing process variables, it is difficult to manufacture the transistors so that the characteristics of all of the transistors of the AMOLED are the same. Therefore, deviation in the threshold voltages of the pixels exists.

In order to reduce or solve such a problem, research on a compensation circuit including a plurality of transistors and capacitors is being performed. The compensation circuit can be formed in each of the pixels. However, in this case, a large number of transistors and capacitors are to be included in each of the pixels.

To be specific, when the compensation circuit is added to each of the pixels, the transistors and capacitors that constitute each of the pixels and signal lines for controlling the transistors are added so that, in the case of a bottom emission AMOLED type display, an aperture ratio is reduced and the possibility of manufacturing defects increases as the number of components of the circuit increase and become more complicated.

In addition, in order to reduce or remove a motion blur phenomenon, high speed scan driving of no less than 120 Hz may be used. However, in this case, charge time per each of the scan lines is significantly reduced. That is, when the compensation circuit is provided in each of the pixels so that a large number of transistors are formed in each of the pixels coupled to one scan line, capacitive load increases. As a result, it is difficult to realize the high speed scan driving.

SUMMARY

Accordingly, aspects of embodiments of the present invention provide an organic light emitting display in which, each of the pixels of the organic light emitting display includes an organic light emitting diode (OLED) and a pixel circuit coupled to the OLED, the pixel circuit includes four transistors and at least one capacitor and the pixel is driven by a concurrent (or simultaneous) emission method so that the threshold voltages of the driving transistors provided in each of the pixels are compensated for by a simple structure and so that high speed driving may be performed.

In order to achieve the foregoing and/or other aspects of the present invention, there is provided an organic light emitting display including a display unit including a plurality of pixels coupled to scan lines, a plurality of first control lines, a plurality of second control lines, and a plurality of data lines, a control line driver configured to provide a first control signal and a second control signal to the plurality of pixels through the first control lines and the second control lines, a first power source driver for applying a first power to the pixels of the display unit, and a second power source driver for applying a second power to the pixels of the display unit. At least one of the first power or the second power is applied to the pixels of the display unit as voltage values having different levels during one frame. The first and second control signals and the first and second powers are concurrently (or simultaneously) provided to all of the pixels of the display unit.

Each of the pixels may include an organic light emitting diode (OLED) having an anode electrode and a cathode electrode, the cathode electrode being coupled to the second power source driver, a first transistor having a gate electrode coupled to a scan line of the scan lines, a first electrode coupled to a data line of the data lines, and a second electrode coupled to a first node, a second transistor having a gate electrode coupled to a second node, a first electrode coupled to the first power source driver, and a second electrode coupled to an anode electrode of the OLED, a first capacitor coupled between the first node and the first electrode of the second transistor, a second capacitor coupled between the first node and the second node, and a third transistor having a gate electrode coupled to a first control line of the first control lines, a first electrode coupled to the gate electrode of the second transistor, and a second electrode coupled to the second electrode of the second transistor.

The organic light emitting display may further include a fourth transistor having a gate electrode coupled to a second control line of the second control lines, a first electrode coupled to the data line, and a second electrode coupled to the first node. The organic light emitting display may further include a fourth transistor having a gate electrode coupled to a second control line of the second control lines, a first electrode coupled to a third power source, and having a second electrode coupled to the first node.

The third power source may be an electrostatic voltage source provides a voltage at a high level.

Each of the pixels may include an organic light emitting diode (OLED) having an anode electrode and a cathode electrode coupled to the second power source driver, a first transistor having a gate electrode coupled to a scan line of the scan lines, a first electrode coupled to a data line of the data lines, and a second electrode coupled to a first node, a second transistor having a gate electrode coupled to the first node, a first electrode coupled to the anode electrode of the OLED, and a second electrode, a third transistor having a gate electrode coupled to a first control line of the control lines, a first electrode coupled to the first electrode of the second transistor, and a second electrode coupled to the first power source, and a capacitor coupled between the gate electrode of the second transistor and the first electrode of the second transistor.

The organic light emitting display may further include a fourth transistor having a gate electrode coupled to a second control line of the second control lines, a first electrode coupled to the data line, and a second electrode coupled to the first node. The organic light emitting display may further include a fourth transistor having a gate electrode coupled to a second control line, a first electrode coupled to a fourth power source, and a second electrode coupled to the first node.

The fourth power source may be an electrostatic voltage source configured to provide a voltage at a low level.

As described above, according to embodiments of the present invention, the plurality of pixels provided in the organic light emitting display are driven by a concurrent (e.g., simultaneous) emission method and a common gate driving circuit is used for realizing the concurrent emission method so that the threshold voltage of the driving transistor provided in each of the pixels may be compensated for by a simple structure and that high speed driving may be performed.

In addition, by the concurrent emission method, it is possible to realize improved performance during 3D display.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
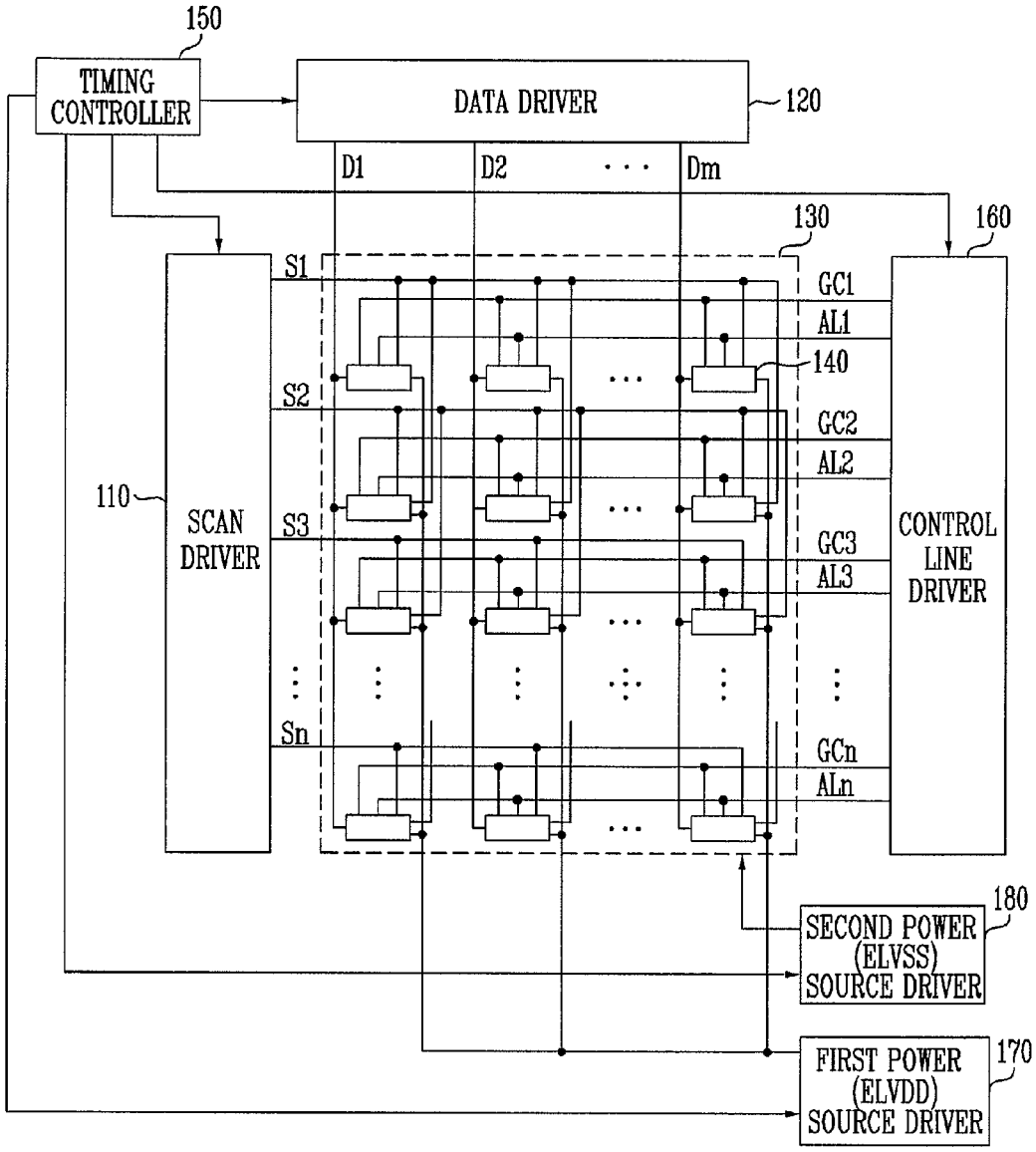
FIG. 1 is a block diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

Figure 2:
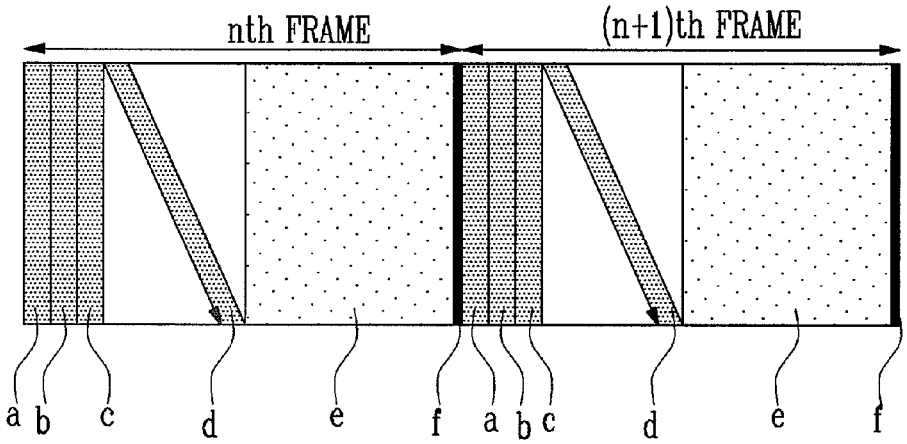
FIG. 2 is a view illustrating the driving operations of a concurrent emission method according to the embodiment of the present invention.

FIG. 1 is a block diagram illustrating an organic light emitting display according to an embodiment of the present invention. FIG. 2 is a view illustrating the driving operations of a concurrent (e.g., simultaneous) emission method according to one embodiment of the present invention.

Referring to FIG. 1, the organic light emitting display according to an embodiment of the present invention includes a display unit 130 including pixels 140 coupled to scan lines S1 to Sn, first control lines GC1 to GCn, second control lines AL1 to ALn, and data lines D1 to Dm, a scan driver 110 for providing scan signals to the pixels through the scan lines S1 to Sn, a control line driver 160 for providing first and second control signals to the pixels through first control lines GC1 to GCn and second control lines AL1 to ALn, a data driver 120 for providing data signals to the pixels through the data lines D1 to Dm, and a timing controller 150 for controlling the scan driver 110, the data driver 120, and the control line driver 160.

In addition, the display unit 130 includes the pixels 140 positioned at the crossing regions of the scan lines S1 to Sn and the data lines D1 to Dm. The pixels 140 receive a first power ELVDD and a second power ELVSS from the outside. The pixels 140 control the amount of current supplied from the first power source driver (supplying the first power ELVDD) to the second power source driver (supplying the second power ELVSS) via organic light emitting diodes (OLEDs) in accordance with the data signals. Then, light having a brightness (e.g., a predetermined brightness) is generated by the OLEDs.

According to one embodiment of the present invention, the first power ELVDD and/or the second power ELVSS are applied to the pixels 140 of the display unit with voltage values in different levels during a period of one frame.

Therefore, a first power source driver 170 for controlling supply of the first power ELVDD and/or a second power source driver 180 for controlling supply of the second power ELVSS are further provided. The first power source driver 170 and/or the second power source driver 180 are controlled by the timing controller 150.

In some displays, the first power source ELVDD is provided as a voltage at a fixed high level and the second power source ELVSS is applied to the pixels of the display unit as a voltage at a fixed low level.

According to one embodiment of the present invention, in providing the first power ELVDD and the second power ELVSS, as described above, during the period of one frame, the first power ELVDD and the second power ELVSS may be applied with different voltage values having different levels, which, in some embodiments, may be realized by the following three methods.

In the first method, the first power ELVDD is applied with voltage values in different three levels and the second power ELVSS is applied at a fixed low level (for example, ground).

That is, in one embodiment of the present invention, because the second power ELVSS has a voltage value at a uniform level (e.g., GND), the second power source driver 180 does not need to be realized by an additional driving circuit and therefore circuit cost may be reduced. On the other hand, because the first power source ELVDD outputs a negative voltage value (for example, −3V) among the three levels, the circuit structure of the first power source driver 170 may be complicated.

In the second method, each of the first power ELVDD and the second power ELVSS is applied with a voltage value having two levels. In this case, both of the first power source driver 170 and the second power source driver 180 are to be provided.

In the third method that is opposite to the first method, the first power ELVDD is applied with a voltage value at a fixed high level and the second power ELVSS is applied with a voltage value at three different levels.

That is, in one embodiment of the present invention, because the first power ELVDD outputs a voltage value at a uniform level, the first power source driver 170 does not need to be realized by an additional driving circuit and therefore circuit cost may be reduced. On the other hand, because the second power has a positive voltage value among the three levels, the circuit structure of the second power source driver 180 may be complicated.

In addition, according to one embodiment of the present invention, in driving the organic light emitting display, a concurrent (e.g., simultaneous) emission method is used (in contrast to a progressive emission method). As illustrated in FIG. 2, data are sequentially input during a period of one frame and after the input of the data is completed, illumination is collectively (or concurrently) performed on data of one frame throughout the entire display unit 130, that is, all of the pixels 140 in the display unit.

That is, in the progressive emission method, data are sequentially supplied to the data lines in accordance with scan signals supplied to the scan lines, and emission is sequentially performed. However, according to one embodiment of the present invention, the data input is sequentially performed but emission is collectively (or concurrently) performed after the data input is completed.

In detail, referring to FIG. 2, a driving process (or period) according to one embodiment of the present invention is divided into (a) an initializing process (or period), (b) a resetting process (or period), (c) a process (or period) of compensating for threshold voltages, (d) a scanning process (or period) (a process of inputting data), (e) an emission process (or period), and (f) an emission off process (or period). (d) The scanning process (the process of inputting data) is sequentially performed on the scan lines, respectively. However, (a) the initializing process, (b) the resetting process, (c) the process of compensating for the threshold voltages, (e) the emission process, and (f) the emission off process are concurrently (e.g., simultaneously) and collectively performed by the display unit 130 as illustrated in FIG. 2.

Here, (a) the initializing process is a period in which the node voltages of the pixel circuits provided in the pixels are initialized in the same way as when the threshold voltages of the driving transistors are compensated for and (b) the resetting process in which the data voltages applied to the pixels 140 of the display unit 130 are reset is a period in which the voltages of the anode electrodes of the OLEDs are reduced to no more than the voltages of the cathode electrodes of the OLEDs so that the OLEDs do not emit light.

In addition, (c) the process of compensating for the threshold voltages is a period in which the threshold voltages of the driving transistors provided in the pixels 140 are compensated for and (f) the emission off process is a period in which emission is turned off for black insertion or dimming after emission is performed by the pixels.

Therefore, the signals applied to (a) the initializing process, (b) the resetting process, (c) the process of compensating for the threshold voltages, (e) the emission process, and (f) the emission off process, that is, the scan signals applied to the scan lines S1 to Sn, the first power ELVDD and/or the second power ELVSS applied to the pixels 140, the first control signals applied to the first control lines GC1 to GCn, and the second control signals applied to the second control lines AL1 to ALn are concurrently and collectively applied to the pixels 140 provided in the display unit 130 at voltage levels (e.g., predetermined voltage levels). In one embodiment, the initializing process may be removed.

In the concurrent emission method according to one embodiment of the present invention, because the operation periods (e.g., the processes (a) to (f)) are temporally clearly divided, the transistors of the compensation circuits provided in the pixels 140 and the number of signal lines for controlling the transistors may be reduced and a shutter glasses type 3D display may be easily realized.

In the shutter glasses type 3D display, when a user looks at a screen wearing shutter glasses in which the transmittances of the left eye and the right eye are switched between 0% and 100%, the left eye image and the right eye image are alternately output from the display unit of an image display, (e.g., an organic light emitting display) onto the displayed screen in each of the frames so that the user looks at the left eye image only with the left eye and looks at the right eye image only with the right eye such that a three dimensional effect is realized.

Figure 3:
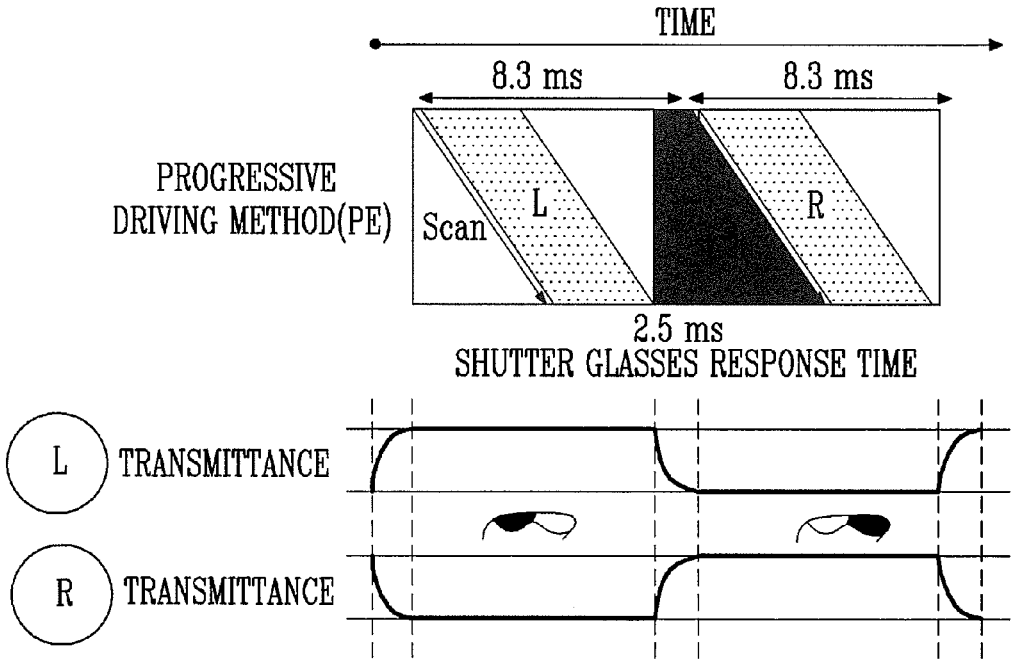
FIG. 3 is a view illustrating an example of realizing a shutter glasses type 3D by a progressive emission method.
Figure 4:
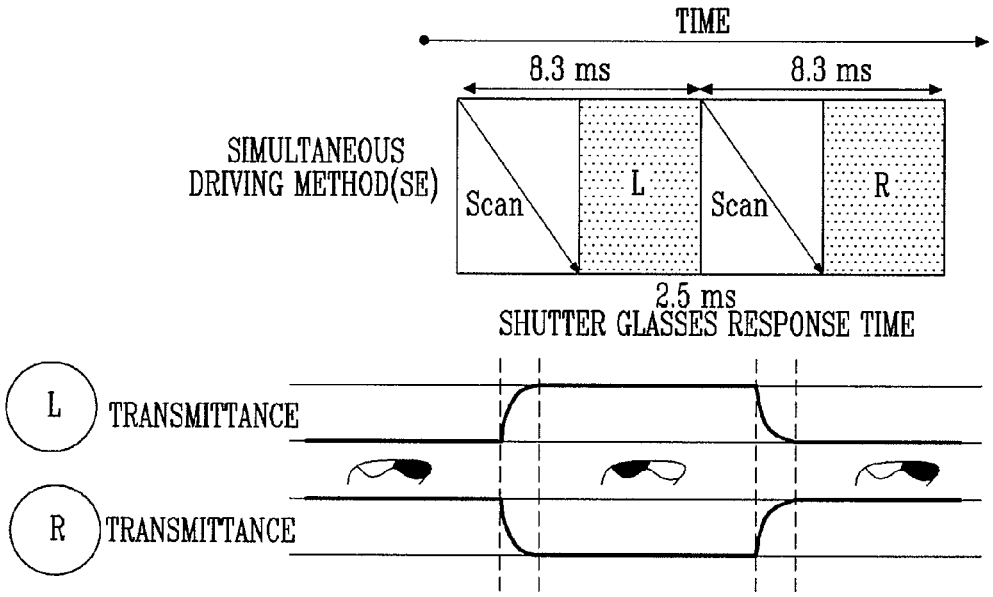
FIG. 4 is a view illustrating an example of realizing shutter glasses type 3D by the concurrent emission method according to the embodiment of the present invention.

FIG. 3 is a diagram illustrating an example of realizing a shutter glasses type 3D by a progressive emission method. FIG. 4 is a view illustrating an example of realizing shutter glasses type 3D by a concurrent emission method according to one embodiment of the present invention.

Figure 5:
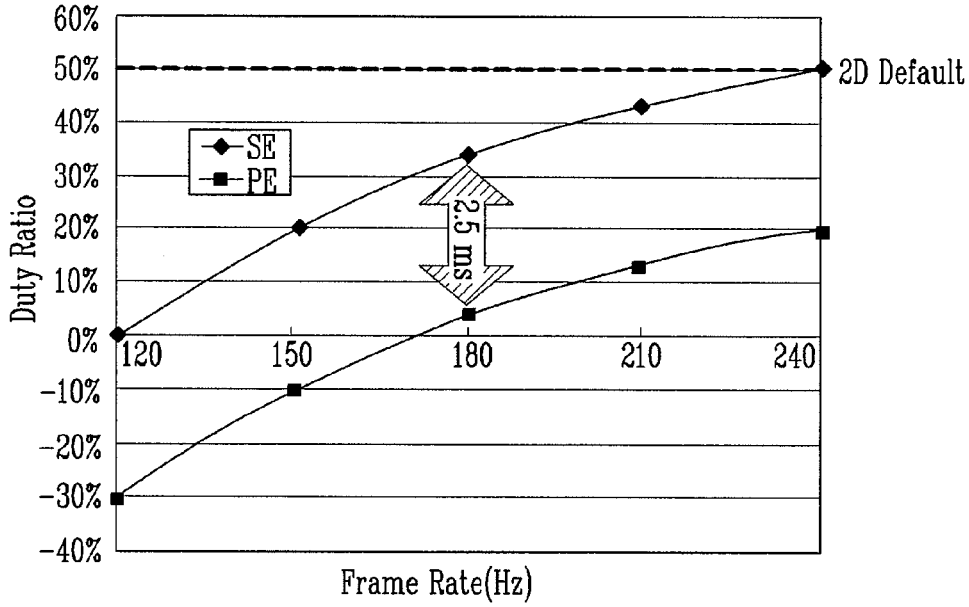
FIG. 5 is a graph for comparing emission time ratios that may be secured in the concurrent emission method and the progressive emission method with each other.

FIG. 5 is a graph for comparing emission time ratios that may be secured in the concurrent emission method and the progressive emission method.

In realizing the shutter glasses type 3D display, when the images are output onto the screen by the above-described progressive emission method, as illustrated in FIG. 3, because the response time (for example, 2.5 ms) of the shutter glasses is limited, in order to prevent a cross talk phenomenon between the left eye and the right eye, emission is to be turned off during the response time.

That is, a non-emission period is additionally generated between a frame (an nth frame) in which the left eye image is output and a frame (an (n+1)th frame) in which the right eye image is output, the non-emission section having a length at least as long as the response time, thereby reducing (or limiting) an emission time ratio (duty ratio) of the display.

In the case of the concurrent (e.g., simultaneous) emission method according to one embodiment of the present invention, referring to FIG. 4, as described above, the emission process is concurrently (e.g., simultaneously) and collectively performed on the entire display unit. During the periods other than the emission process, non-emission is performed (e.g., light is not emitted) so that the non-emission period between the period in which the left eye image is output and the period in which the right eye image is output is naturally secured.

That is, because light is not emitted during the emission off period, the reset period, and the threshold voltage compensating period between the emission period of the nth frame and the emission period of the (n+1)th frame, in order to synchronize the entire time of the non-emission period with the response time (for example, 2.5 ms) of the shutter glasses, unlike in the progressive emission method, the emission time ratio (duty ratio) does not need to be additionally reduced.

Therefore, in realizing the shutter glasses type 3D display, because an increased emission time ratio (duty ratio) may be secured by the concurrent emission method in comparison with the progressive emission method by the response time of the shutter glasses, improved performance may be realized, as shown in the graph of FIG. 5.

Figure 6A:
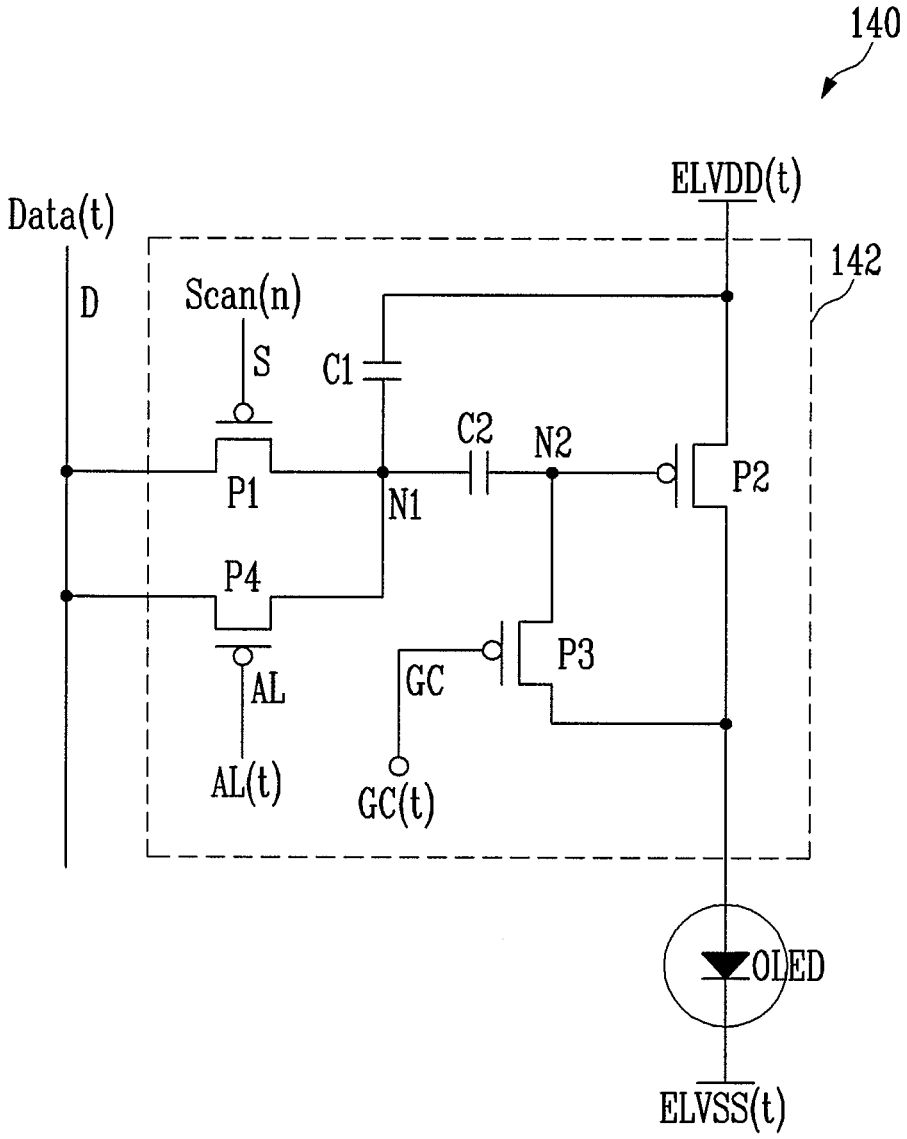
FIGS. 6A and 6B are circuit diagrams illustrating pixel circuits according to embodiments of the present invention which may be used with the embodiment of the pixel of FIG. 1.
Figure 6B:
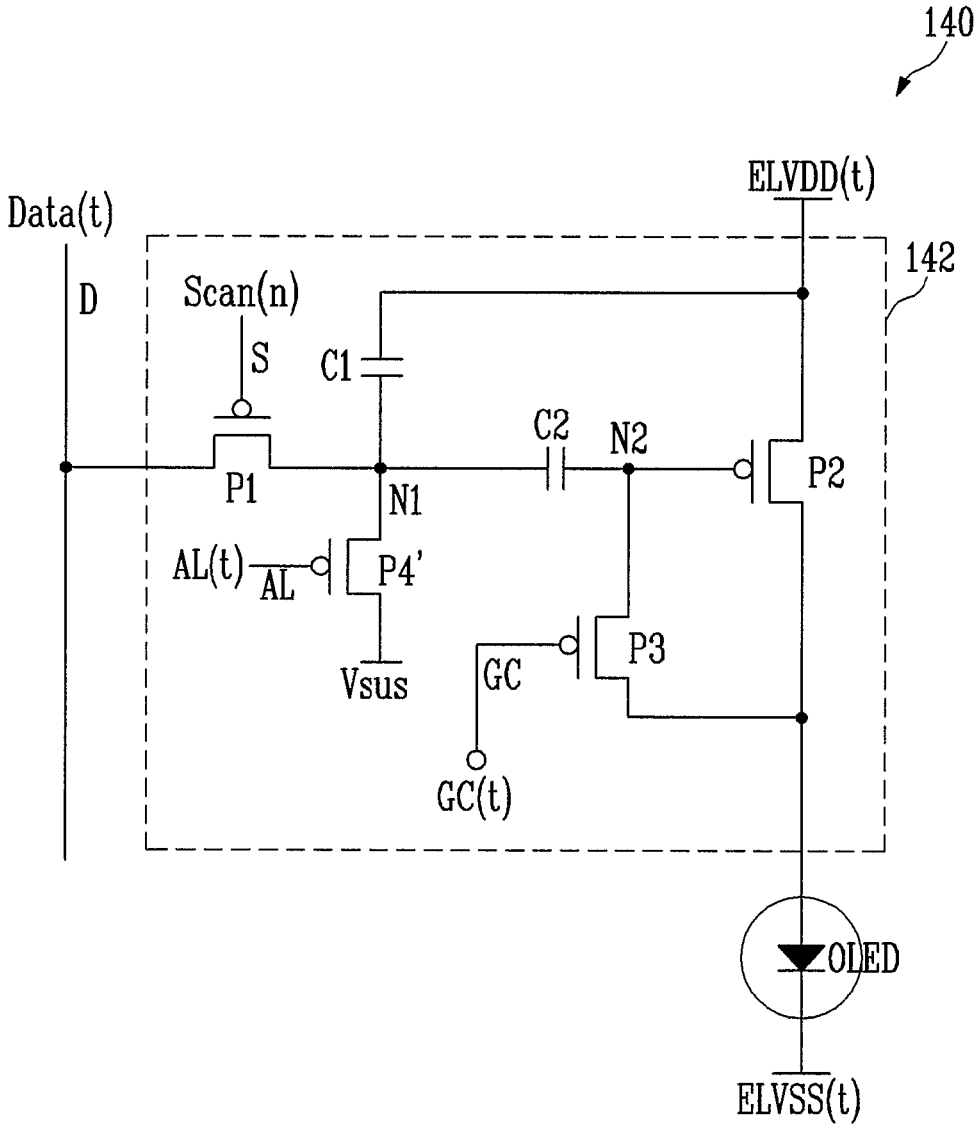
Figure 7:
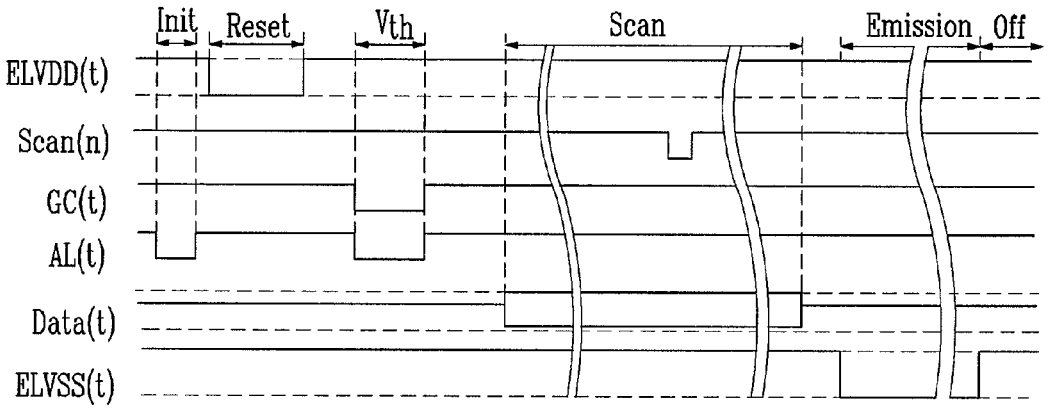
FIG. 7 is a driving timing diagram illustrating driving waveforms which may be applied to the pixels of FIGS. 6A and 6B according to one embodiment of the present invention.

FIGS. 6A and 6B are circuit diagrams illustrating pixel circuits which may be used with one embodiment of the pixel of FIG. 1. FIG. 7 is a driving timing diagram illustrating driving waveforms which may be used with the pixels of FIGS. 6A and 6B.

First, referring to FIG. 6A, a pixel 140 according to one embodiment of the present invention includes an organic light emitting diode (OLED) and a pixel circuit 142 for supplying current to the OLED.

The anode electrode of the OLED is coupled to the pixel circuit 142 and the cathode electrode of the OLED is coupled to the second power source. The OLED generates light having a brightness (e.g., a predetermined brightness) in accordance with the current supplied from the pixel circuit 142.

According to one embodiment of the present invention, the pixels 140 that constitute the display unit 130 receive the data signals supplied to the data lines D1 to Dm when the scan signals are sequentially supplied to the scan lines S1 to Sn during a partial period (the above-described process (d)) of one frame. However, during the remaining periods (e.g., the processes (a), (b), (c), (e), and (f)) of one frame, the scan signals applied to the scan lines S1 to Sn, the first power ELVDD and/or the second power ELVSS applied to the pixels 140, and the first and second control signals applied to the first control lines GC1 to GCn and the second control lines AL1 to ALn are concurrently and collectively applied to the pixels 140 at voltage levels (e.g., predetermined voltage levels).

The pixel circuit 142 provided in each of the pixels 140 includes four transistors P1 to P4 and two capacitors C1 and C2.

The gate electrode of the first transistor P1 is coupled to a scan line S of the scan lines S1 to Sn and the first electrode of the first transistor P1 is coupled to a data line D of the data lines D1 to Dn. Then, the second electrode of the first transistor P1 is coupled to the first node N1.

The scan signal Scan(n) is supplied to the gate electrode of the first transistor P1 and the data signal Data(t) is supplied to the first electrode of the first transistor P1.

In addition, the gate electrode of the second transistor P2 is coupled to the second node N2, the first electrode of the second transistor P2 is coupled to the first power source driver supplying the first power ELVDD(t), and the second electrode of the second transistor P2 is coupled to an anode electrode of the OLED. The second transistor P2 functions as a driving transistor.

In addition, the first capacitor C1 is coupled between the first node N1 and the first electrode of the second transistor P2 (e.g., the first power source driver supplying the first power ELVDD(t)) and the second capacitor C2 is coupled between the first node N1 and the second node N2.

In addition, the gate electrode of the third transistor P3 is coupled to the first control line GC, the first electrode of the third transistor P3 is coupled to the gate electrode of the second transistor P2, and the second electrode of the third transistor P3 is coupled to the anode electrode of the OLED (e.g., the second electrode of the second transistor P2).

Therefore, the control signal GC(t) is input to the gate electrode of the third transistor P3 and, when the third transistor is turned on, the second transistor P2 is diode coupled.

In addition, the cathode electrode of the OLED is coupled to the second power source driver for supplying the second power ELVSS(t).

In addition, the gate electrode of the fourth transistor P4 is coupled to the second control line AL, the first electrode of the fourth transistor P4 is coupled to the data line D, and the second electrode of the fourth transistor P4 is coupled to the second electrode of the first transistor P1 (e.g., the first node N1).

In the embodiments illustrated in FIGS. 6A and 6B, the signal applied to the first electrode (the source electrode) of the fourth transistor is different and the other elements are the same.

That is, in the embodiment illustrated in FIG. 6B, a difference lies in that the first electrode of the fourth transistor P4' is not coupled to the data line D but is coupled to a third power source Vsus. Therefore, the gate electrode of the fourth transistor P4' is coupled to the second control line AL, the first electrode of the fourth transistor P4' is coupled to the third power source Vsus, and the second electrode of the fourth transistor P4' is coupled to the second electrode of the first transistor P1 (e.g., the first node N1). Here, the third power source Vsus provides a high level voltage as an electrostatic voltage source.

According to the embodiment illustrated in FIG. 6B, the third power source Vsus is an electrostatic voltage source that is used instead of the voltage applied by the data line D so that the current burden of the data driver may be reduced.

When the fourth transistor is turned on by the second control signal applied to the second control line AL, because the voltages are at the same level (e.g., at a high level) are applied to the first electrode in the embodiments of FIGS. 6A and 6B, the operations of circuits according to the embodiments illustrated in FIGS. 6A and 6B are the same.

In the embodiments illustrated in FIGS. 6A and 6B, the first to fourth transistors P1 to P4 are realized by PMOS transistors.

As described above, the pixels 140 according to one embodiment of the present invention are driven by the concurrent (e.g., simultaneous) emission method. In detail, as illustrated in FIG. 7, each of the frames is divided into an initializing period Init, a reset period Reset, a threshold voltage compensating period Vth, a scan/data input period Scan, an emission period Emission, and an emission off period Off.

During the scan/data input period, the scan signals are sequentially input to the scan lines so that the data signals are sequentially input to the pixels (e.g., rows of pixels). However, during the other periods, signals having voltage values at levels (e.g., predetermined levels), that is, the first power ELVDD(t) and/or the second power ELVSS(t), the scan signal Scan(n), the first control signal GC(t), the second control signal AL(t), and the data signal Data(t) are collectively (or concurrently) applied to the pixels 140.

That is, the compensation of the threshold voltages of the driving transistors provided in the pixels 140 and the emission of the pixels are concurrently (e.g., simultaneously) realized by all of the pixels 140 in the display unit during each of the frames.

In one embodiment of the present invention, the first power ELVDD(t) and/or the second power ELVSS(t) may be provided in the above-described three methods. However, for the sake of convenience, in the embodiment shown in FIG. 7, the first power ELVDD and the second power ELVSS are applied with the voltage values having two levels.

A method of driving the pixels according to one embodiment of the present invention, that is, the above-described operations during the periods (the initializing period Init, the reset period Reset, the threshold voltage compensating period Vth, the scan/data input period Scan, the emission period Emission, and the emission off period Off) will be sequentially described as follows with reference to FIGS. 6 and 7.

First, during the initializing period, the first power ELVDD (t), the second power ELVSS(t), the scan signal Scan(n), and the first control signal GC(t) are applied at a high level (or a high voltage level) and only the second control signal AL(t) is applied at a low level (or a low voltage level).

That is, in the pixel circuit illustrated in FIGS. 6A and 6B, only the fourth transistor P4 or P4' is turned on, the remaining transistors are all turned off, and the fourth transistor is turned on so that a high level voltage as an initializing voltage is applied to the first node N1.

In the embodiment of FIG. 6A, the initializing voltage is transmitted through the data line and, in the embodiment of FIG. 6B, is applied through (or from) the third power source Vsus.

In addition, because the initializing process is collectively (or concurrently) applied to the pixels that constitute the display unit, the signals applied during the initializing process, that is, the first power ELVDD(t), the scan signal Scan (n), the first control signal GC(t), the second control signal AL(t), and the data signal Data(t) having voltage values at levels (e.g., predetermined levels) are concurrently (e.g., simultaneously) applied to all of the pixels.

All of the transistors are turned off during the initializing period as a period that may be removed and after which the resetting process may be performed. That is, the second control signal AL(t) at a high level may be applied during the initializing period.

Then, during the resetting period when the data voltages are applied to the pixels 140 of the display unit 130 (e.g., the pixels illustrated in FIG. 6 are reset), the voltages of the anode electrodes of the OLEDs are reduced to no more than the voltages of the cathode electrodes so that the OLEDs do not emit light.

During the resetting period, as illustrated in FIG. 7, the first power ELVDD(t) is applied at a low level and the second power ELVSS(t), the scan signal Scan(n), the first control signal GC(t), and the second control signal AL(t) are applied at a high level.

When the first power ELVDD(t) is applied at a low level, the voltage of the first node N1 is lower than the voltage during the initializing period due to a coupling effect between the first capacitor C1 and the second capacitor C2.

Therefore, the second transistor P2 realized by a PMOS is turned on and a current path between the first electrode and the second electrode of the second transistor P2 is formed so that the voltage charged in the anode electrode of the OLED coupled to the second electrode of the second transistor P2 is reduced to the voltage of the first power. That is, the anode electrode voltage of the OLED is reset.

In addition, because the resetting process is collectively (or concurrently) applied to the pixels that constitute the display unit, the signals applied during the initializing process, that is, the first power ELVDD(t), the scan signal Scan(n), the first control signal GC(t), the second control signal AL(t), and the data signal Data(t) are concurrently applied to all of the pixels with the voltage values at levels (e.g., predetermined levels).

Then, the threshold voltage compensating period, in which the threshold voltage of the driving transistor P2 provided in each of the pixels 140 of the display unit 130 is stored in the capacitor Cst, reduces or removes defects caused by deviations in the threshold voltages of the driving transistors when the data voltage is charged in each of the pixels.

During the threshold voltage compensating period, as illustrated in FIG. 7, the first power ELVDD(t), the second power ELVSS(t), and the scan signal Scan(n) are applied at a high level and the first control signal GC(t) and the second control signal AL(t) are applied at a low level.

Because the first control signal GC(t) is applied at a low level, the third transistor P3 is turned on so that the gate electrode of the second transistor P2 and the second electrode of the third transistor P3 are electrically coupled to each other and that the second transistor P2 operates as a diode (e.g., is diode coupled).

Therefore, the threshold voltage of the second transistor P2 is stored in the second capacitor C2 coupled to the second node N2 and offsets the voltage stored in the first capacitor C1 stored during the data inputting period so that defect caused by deviation in the threshold voltage of the driving transistor is removed by (or compensated for in) the current applied to the OLED.

In addition, because the threshold voltage compensating process is collectively (or concurrently) applied to the pixels that constitute the display unit, the signals applied during the threshold voltage compensating process, that is, the first power ELVDD(t), the scan signal Scan(n), the control signal GC(t), and the data signal Data(t) are concurrently applied to all of the pixels with the voltage values at levels (e.g., predetermined levels).

According to one embodiment of the present invention, during the initializing period, the resetting period, and the threshold voltage compensating period, the scan signals maintain a high level to perform an output operation. In the progressive driving method, no problem occurs although a common gate driver is used because the signals are applied at different times. Therefore, no problem occurs although a common gate driver(wide use gate driving IC) applied to the conventional progressive driving method is used.

That is, according to one embodiment of the present invention, in order to realize the concurrent (e.g., simultaneous) emission method, a problem may occur when the signals output from the gate driver to the scan lines are to be concurrently applied at a low level in order to initialize the voltage of the first node N1. This problem may be reduced or solved by applying the second control signal AL(t) to the fourth transistor. Therefore, a wide use gate driving IC may be introduced even when driving is performed by the concurrent emission method and a circuit charge area may be reduced or minimized when mounting (or using) the gate driver in a panel.

After the threshold voltage compensating period, during the scan/data inputting period, the scan signals at a low level are sequentially input to respective scan lines. In accordance with the scan signals, the data signals are sequentially input to the pixels coupled to the scan lines.

During the threshold voltage compensating period, as illustrated in FIG. 7, the first control signal GC(t) and the second control signal AL(t) are applied at a high level so that the fourth transistors (P4 and/or P4') and the third transistor P3 are turned off.

That is, during the threshold voltage compensating period, the scan signals and the data signals are applied in the same way as the reset period.

During the threshold voltage compensating period, because the second power ELVSS(t) is applied at a high level having a voltage substantially the same as the first power ELVDD(t), a current path is not formed between the OLED and the first power source supplying the first power ELVDD (t) so that current does not flow to the OLED. That is, in one embodiment of the present invention, emission is not performed during the threshold voltage compensating period.

Then, during the emission period where a current corresponding to the data voltage stored in each of the pixels 140 of the display unit 130 is provided to the OLED provided in each of the pixels so that emission is performed, unlike during the scan/data input period, the second power ELVSS(t) is applied at a low level.

Therefore, during the emission period, because the second power ELVSS(t) is applied at a low level, as the second transistor P2 is turned on, a current path between the first power source driver and the cathode electrode of the OLED is formed. Therefore, the current corresponding to the voltage having the voltage value Vgs of the second transistor P2, that is, a difference between the gate electrode and the first electrode of the second transistor P2 is applied to the OLED and light is emitted with the brightness corresponding to the current.

Because the emission process is collectively (or concurrently) applied to the pixels that constitute the display unit, the signals applied during the emission process, that is, the first power ELVDD(t), the scan signal Scan(n), the first control signal GC(t), the second control signal AL(t), and the data signal Data(t) are concurrently applied to all of the pixels with the voltage values at levels (e.g., predetermined levels).

Then, after the emission of the display unit is performed, the second power ELVSS(t) is provided to at a high level to perform the emission off process.

During the emission off process where emission is turned off for black insertion or dimming, the voltage of the anode electrode of the OLED is reduced to the voltage at which emission is turned off within several hundred microseconds (ps) when the OLED emitted light before.

Figure 8A:
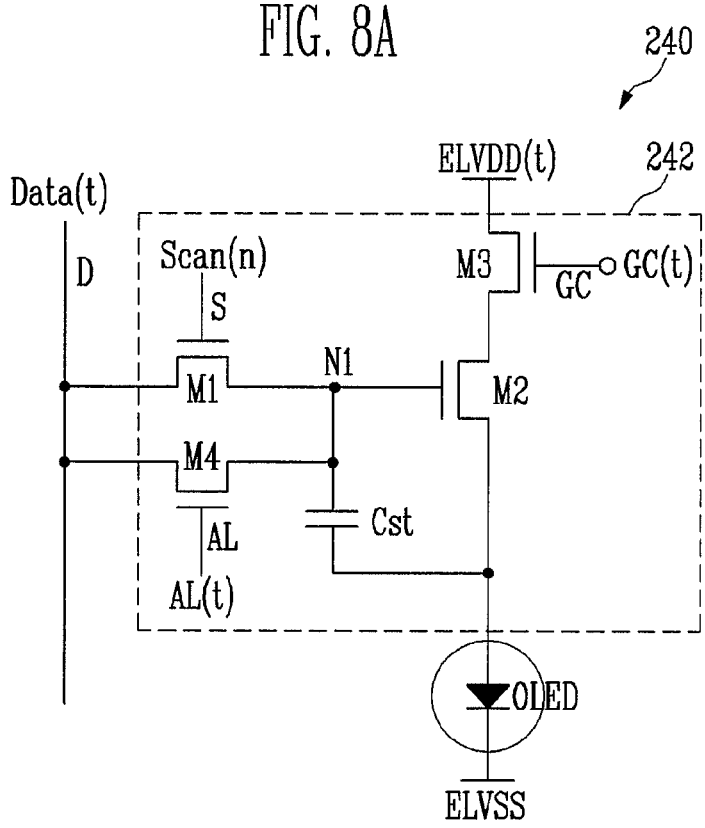
FIGS. 8A and 8B are circuit diagrams illustrating pixel circuits according to embodiments of the present invention which may be used with the embodiment of the pixel of FIG. 1.
Figure 8B:
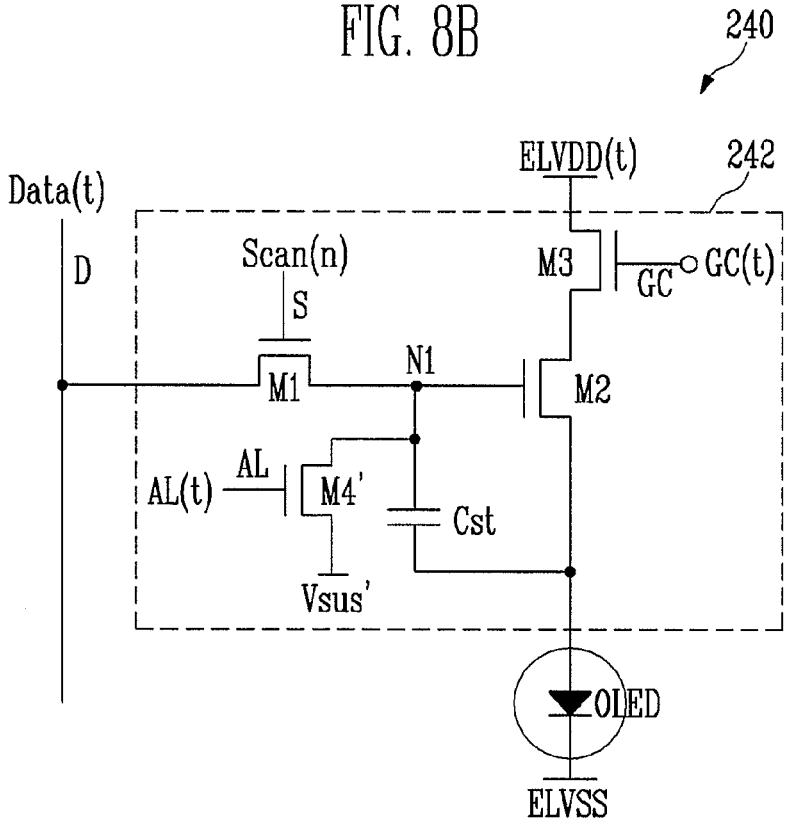

FIGS. 8A and 8B are circuit diagrams illustrating pixel circuits according to embodiments of the present invention which may be used with the embodiment of the pixel of FIG. 1.

Figure 9:
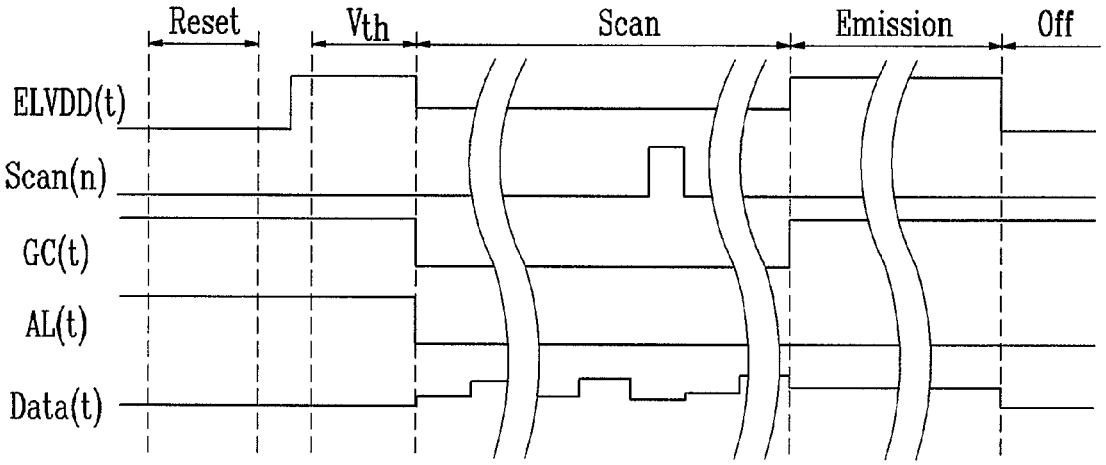
FIG. 9 is a driving timing diagram illustrating driving waveforms which may be applied to the pixels of FIGS. 8A and 8B according to one embodiment of the present invention.

FIG. 9 is a driving timing diagram illustrating driving waveforms which may be applied to the pixels of FIGS. 8A and 8B according to one embodiment of the present invention.

Referring to FIG. 8A, a pixel 240 according to another embodiment of the present invention includes an organic light emitting diode (OLED) and a pixel circuit 242 for supplying current to the OLED.

The anode electrode of the OLED is coupled to the pixel circuit 242 and the cathode electrode of the OLED is coupled to the second power source driver supplying the second power ELVSS. The OLED generates light having a brightness (e.g., a predetermined brightness) in accordance with the current supplied from the pixel circuit 242.

According to one embodiment of the present invention, the pixels 140 that constitute the display unit 130 receive the data signals supplied from the data lines D1 to Dm when the scan signals are sequentially supplied to the scan lines S1 to Sn during a partial period of one frame. However, the scan signals applied to the scan lines S1 to Sn, the first power ELVDD applied to the pixels 140, the first and second signals applied to the first control lines GC1 to GCn and the second control lines AL1 to ALn are concurrently (e.g., simultaneously) and collectively applied to the pixels 140 at voltage levels (e.g., predetermined voltage levels).

Therefore, the pixel circuit 242 provided in each of the pixels 240 includes four transistors M1 to M4 and a first capacitor Cst. In one embodiment of the present invention, pixel 240 may be used in place of pixel 140 of the embodiment of FIG. 1.

The gate electrode of the first transistor M1 is coupled to the scan line S of the scan lines and the first electrode of the first transistor M1 is coupled to the data line D of the data lines. The second electrode of the first transistor M1 is coupled to the first node N1.

That is, the scan signal Scan(n) is input to the gate electrode of the first transistor M1 and the data signal Data(t) is input to the first electrode of the first transistor M1.

The gate electrode of the second transistor M2 is coupled to the first node N1 and the first electrode of the second transistor M2 is coupled to the anode electrode of the OLED. The second electrode of the second transistor M2 is coupled to the first power ELVDD(t) through the first and second electrodes of the third transistor M3. The second transistor M2 functions as a driving transistor.

That is, the gate electrode of the third transistor M3 is coupled to the first control line GC, the first electrode of the third transistor M3 is coupled to the second electrode of the second transistor M2, and the second electrode of the third electrode M3 is coupled to the first power ELVDD(t).

Therefore, the control signal GC(t) is input to the gate electrode of the third transistor M3 and the first power ELVDD(t) that varies to at a level (e.g., a predetermined level) to be provided is supplied to the second electrode of the third transistor M3.

In addition, the cathode electrode of the OLED is coupled to the second power source driver supplying the second power ELVSS and the capacitor Cst is coupled between the gate electrode of the second transistor M2 (e.g., the first node N1) and the first electrode of the second transistor M2 (e.g., the anode electrode of the OLED).

In addition, the gate electrode of the fourth transistor M4 is coupled to the second control line AL, the first electrode of the fourth transistor M4 is coupled to the data line D, and the second electrode of the fourth transistor M4 is coupled to the second electrode of the first transistor M1 (e.g., the first node N1).

At this time, in the embodiments illustrated in FIGS. 8A and 8B, the signals applied to the first electrode of the fourth transistor (the source electrode) are different but the other elements are the same.

According to the embodiment shown in FIG. 8B, a difference lies in that the first electrode of the fourth transistor M4' is not coupled to the data line D but is coupled to a fourth power source Vsus'. Therefore, the gate electrode of the fourth transistor M4' is coupled to the second control line AL, the first electrode of the fourth transistor M4' is coupled to the fourth power source Vsus', and the second electrode of the fourth transistor M4' is coupled to the second electrode of the first transistor M1 (e.g., the first node N1). In one embodiment, the fourth power source Vsus' is an electrostatic voltage source provides a voltage at a low level.

According to the embodiment shown in FIG. 8B, the fourth power source Vsus' (e.g., an electrostatic voltage source) is used instead of the voltage applied from the data line D so that the current burden of the data driver may be reduced.

When the fourth transistor is turned on by the second control signal applied to the second control line AL, because the voltages at the same level (e.g., at a low level) are applied to the first electrode of the fourth transistor in the embodiments of FIGS. 8A and 8B, the operations of the circuits according to the embodiments of FIGS. 8A and 8B are the same.

According to the embodiments of FIGS. 8A and 8B, the first to fourth transistors M1 to M4 are realized by NMOS transistors.

The pixels 140 according to one embodiment of the present invention are driven by the concurrent (e.g., simultaneous) emission method. The concurrent emission method is divided into the resetting period Reset, the threshold voltage compensating period Vth, the scan/data inputting period Scan, the emission period Emission, and the emission off period Off in each of the frames as illustrated in FIG. 9.

That is, in one embodiment of the present invention, unlike in the embodiments of FIGS. 6 and 7, the initializing period is removed.

During the scan/data inputting period, the scan signals are sequentially input to the scan lines and the data signals are sequentially input to the pixels (e.g., rows of pixels). However, during the other periods, the signals having voltage values at levels (e.g., predetermined levels), that is, the first power ELVDD(t), the scan signal Scan(n), the control signal GC(t), and the data signal Data(t) are collectively (or concurrently) applied to the pixels 140 that constitute the display unit.

The operations of compensating for the threshold voltage of the driving transistor provided in each of the pixels 140 and of emitting light of the pixels are concurrently realized by all of the pixels 140 in the display unit.

According to one embodiment of the present invention, the first power ELVDD(t) and/or the second power ELVSS(t) may be provided by the above-described three methods. However, for the sake of convenience, in the embodiment shown in FIG. 9, the first power ELVDD is applied at three levels and the second power ELVSS is applied at a fixed level.

Referring to FIGS. 8 and 9, a method of driving the pixels according to one embodiment of the present invention, that is, the operations during the above-described periods (the resetting period Reset, the threshold voltage compensating period Vth, the scan/data inputting period Scan, the emission period Emission, and the emission off period Off) will be described.

First, during the reset period, as illustrated in FIG. 9, the first power ELVDD(t) and the scan signal Scan(n) are applied at a low level and the first control signal GC(t) and the second control signal AL(t) are applied at a high level.

In addition, during the reset period, the data signal Data(t) has a voltage having a value corresponding to the magnitude of the threshold voltage of the second transistor M2 (e.g., the driving transistor) is applied.

In addition, because the resetting process is collectively (or concurrently) applied to the pixels that constitute the display unit, the signals applied during the reset process, that is, the first power ELVDD(t), the scan signal Scan(n), the control signal GC(t), and the data signal Data(t) are concurrently (e.g., simultaneously) applied to all of the pixels with voltage values at levels (e.g., predetermined levels).

According to the application of the above-described signals, the fourth transistors M4 and M4', the third transistor M3, and the second transistor M2 are turned on.

Therefore, because the voltage applied to the data signal (the voltage corresponding to the threshold voltage of the second transistor M2) is applied to the first node N1 and a current path between the anode electrode of the OLED and the first power source is formed by turning on the second and third transistors, the voltage value is reduced to a voltage at a low level (e.g., the voltage value of the first power ELVDD (t)).

During the threshold voltage compensating period, as illustrated in FIG. 9, the first power ELVDD(t) is applied at a high level, the scan signal Scan(n) is applied at a low level and the first control signal GC(t) and the second control signal AL(t) are applied at a high level, like during the previous resetting period, and the data signal Data(t) maintains the same voltage value as during the previous resetting period.

In addition, because the threshold voltage compensating period is collectively (or concurrently) applied to the pixels that constitute the display unit, the signals applied during the threshold voltage compensating process, that is, the first power ELVDD(t), the scan signal Scan(n), the first control signal GC(t), the second control signal AL(t), and the data signal Data(t) are concurrently applied to all of the pixels with the voltage values at levels (e.g., predetermined levels).

According to the application of the above-described signals, the fourth transistors M4 and M4', the third transistor M3, and the second transistor M2 are turned on.

The second transistor M2 is turned on until Vgs (e.g., a voltage difference between the gate electrode and the first electrode of the second transistor M2) corresponds to the threshold voltage of the second transistor M2 and is turned off after the voltage difference corresponds to the threshold voltage of the second transistor M2.

That is, because a current path between the anode electrode of the OLED and the first power source driver is formed by turning on the second and third transistors, the voltage of the anode electrode of the OLED, which is reduced to the low level of the first power ELVDD during the initial resetting process, increases to the voltage of the gate electrode of the second transistor M2 (e.g., the threshold voltage of the second transistor). Therefore, the voltage corresponding to the threshold voltage of the second transistor M2 is stored in the capacitor Cst.

According to one embodiment of the present invention, the scan signals maintain a low level to be output during the resetting period and the threshold voltage compensating period. In the progressive driving method, no problem occurs although a common gate driver is used because the signals are applied at different times.

According to one embodiment of the present invention, in order to realize the concurrent emission method, a problem may occur when the signals output from the gate driver to the scan lines are concurrently applied at a high level in order to initialize the voltage of the first node N1. This problem may be reduced or solved by applying the second control signal AL(t) to the fourth transistor. Therefore, a wide use gate driving IC may be introduced even when driving is performed by the concurrent emission method and a circuit charge area may be reduced or minimized when using or mounting the gate driver in a panel.

After the threshold voltage compensating period, during the scan/data inputting period, the scan signals at a high level are sequentially supplied to the scan lines. In accordance with the scan signals, the data signals are sequentially supplied to the pixels coupled to the scan lines.

During the scan/data inputting period, as illustrated in FIG. 9, the first control signal GC(t) and the second control signal AL(t) are applied at a low level so that the fourth transistors M4 and M4' and the third transistor M3 are turned off.

That is, in the scan/data inputting period, the scan signals and the data signals are applied in a manner similar to that of the concurrent driving method according to one embodiment of the present invention illustrated in FIG. 7.

During the scan/data inputting period, because the first power ELVDD(t) is applied at a relatively low level, a current path is not formed between the OLED and the first power ELVDD(t) so that current does not flow to the OLED. That is, in one embodiment of the present invention, emission is not performed during the scan/data inputting period.

In one embodiment of the present invention, the low level of the first power ELVDD(t), applied during the scan/data inputting period, may be applied as a voltage value different from the low level applied during the resetting period and the threshold voltage compensating period as illustrated in FIG. 9.

Then, during the emission period where the current corresponding to the data voltage stored in each of the pixels 140 of the display unit 130 is provided to the OLED provided in each of the pixels so that emission is performed, unlike during the scan/data input period, the second power ELVSS(t) is applied at a high level.

Therefore, during the emission period, because the first power ELVDD(t) is applied at a high level, as the second transistor M2 is turned on, a current path between the first power source driver and the cathode electrode of the OLED is formed. Therefore, a current corresponding to the voltage having the voltage value Vgs of the second transistor M2, that is, a difference between the gate electrode and the first electrode of the second transistor P2 is applied to the OLED and light is emitted with the brightness corresponding to the current.

Because the emission process is collectively (or concurrently) applied to the pixels that constitute the display unit, the signals applied during the emission process, that is, the first power ELVDD(t), the scan signal Scan(n), the first control signal GC(t), the second control signal AL(t), and the data signal Data(t) are concurrently applied to all of the pixels with the voltage values at levels (e.g., predetermined levels).

Then, after the emission of the display unit is performed, the first power ELVDD(t) is provided to at a low level to perform the emission off process.

During the emission off process where emission is turned off for black insertion or dimming, the voltage of the anode electrode of the OLED is reduced to the voltage at which emission is turned off within several hundreds microseconds (ps) when the OLED emitted light before.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a display unit comprising a plurality of pixels coupled to a plurality of scan lines, a plurality of first control lines, a plurality of second control lines, and a plurality of data lines;

a control line driver configured to provide a first control signal and a second control signal to the plurality of pixels through the plurality of first control lines and the plurality of second control lines;

a first power source driver configured to supply a first power to the plurality of pixels of the display unit; and a second power source driver configured to supply a second power to the plurality of pixels of the display unit, wherein the first power and the second power are applied to the pixels of the display unit to supply a voltage difference between the first power and second power, the voltage difference being computed by subtracting the voltage of the second power from the voltage of the first power, the voltage difference having at least three different voltage levels during one frame, the voltage of the first power having at least two different voltage levels during the one frame, and the voltage of the second power having at least two different voltage levels during the one frame, the at least two different voltage levels comprising a high voltage and a low voltage, wherein the data lines are configured to supply a plurality of data signals to the pixels during a scan period of the one frame, wherein the voltage of the first power and the voltage of the second power are at the high voltage of the at least two different voltage levels during the scan period, and wherein the first and second control signals and the first and second powers are concurrently provided to all of the pixels of the display unit.

2. The organic light emitting display as claimed in claim 1, wherein each of the pixels comprises:

an organic light emitting diode (OLED) having an anode electrode and a cathode electrode, the cathode electrode being coupled to the second power source driver;

a first transistor having a gate electrode coupled to a scan line of the scan lines, a first electrode coupled to a data line of the data lines, and a second electrode coupled to a first node;

a second transistor having a gate electrode coupled to a second node, a first electrode coupled to the first power source driver, and a second electrode coupled to the anode electrode of the OLED;

a first capacitor coupled between the first node and the first electrode of the second transistor;

a second capacitor coupled between the first node and the second node; and a third transistor having a gate electrode coupled to a first control line of the first control lines, a first electrode coupled to the gate electrode of the second transistor, and a second electrode coupled to the second electrode of the second transistor.

3. The organic light emitting display as claimed in claim 2, further comprising a fourth transistor having a gate electrode coupled to a second control line of the second control lines, a first electrode coupled to the data line, and a second electrode coupled to the first node.

4. The organic light emitting display as claimed in claim 2, further comprising a fourth transistor having a gate electrode coupled to a second control line of the second control lines, a first electrode coupled to a third power source, and a second electrode coupled to the first node.

5. The organic light emitting display as claimed in claim 4, wherein the third power source is an electrostatic voltage source configured to provide a voltage at a high level.

6. The organic light emitting display as claimed in claim 1, wherein each of the pixels comprises:

an organic light emitting diode (OLED) having an anode electrode and a cathode electrode coupled to the second power source driver;

a first transistor having a gate electrode coupled to a scan line of the scan lines, a first electrode coupled to a data line of the data lines, and a second electrode coupled to a first node;

a second transistor having a gate electrode coupled to the first node, a first electrode coupled to the anode electrode of the OLED, and a second electrode;

a third transistor having a gate electrode coupled to a first control line of the first control lines, a first electrode coupled to the second electrode of the second transistor, and having a second electrode coupled to the first power source; and a capacitor coupled between the gate electrode of the second transistor and the first electrode of the second transistor.

7. The organic light emitting display as claimed in claim 6, further comprising a fourth transistor having a gate electrode coupled to a second control line of the second control lines, a first electrode coupled to the data line, and a second electrode coupled to the first node.

8. The organic light emitting display as claimed in claim 6, further comprising a fourth transistor having a gate electrode coupled to a second control line of the second control lines, a first electrode coupled to a fourth power source, and a second electrode coupled to the first node.

9. The organic light emitting display as claimed in claim 8, wherein the fourth power source is an electrostatic voltage source configured to provide a voltage at a low level.

* * * * *